US006005336A

United States Patent [19]

Helbig et al.

[11] Patent Number: 6,005,336

[45] Date of Patent: Dec. 21, 1999

[54] ELECTRIC VEHICLE LAMP WITH INSERTED INSULATION PLUG

[75] Inventors: Peter Helbig, Sontheim; Hermann Steiner, Herbrechtingen, both of Germany

[73] Assignee: Patent-Treuhand-Gesellschaft fuer elektrische Gluehlampen mbH, Munich, Germany

[21] Appl. No.: 08/981,232

[22] PCT Filed: Apr. 17, 1997

[86] PCT No.: PCT/DE97/00771

§ 371 Date: Dec. 19, 1997

§ 102(e) Date: Dec. 19, 1997

[87] PCT Pub. No.: WO97/40521

PCT Pub. Date: Oct. 30, 1997

[30] Foreign Application Priority Data

Apr. 24, 1996 [DE] Germany ..... 196 16 409

[51] Int. Cl.[6] ..... H01J 5/50; H01J 5/48

[52] U.S. Cl. ..... 313/318.01; 313/318.1; 313/318.03

[58] Field of Search ..... 313/318.01, 318.03, 313/318.05, 318.07, 318.09, 318.1, 318.12

[56] References Cited

U.S. PATENT DOCUMENTS 5,610,472 3/1997 Schmitt, Jr. ..... 313/318.12

FOREIGN PATENT DOCUMENTS 0172529 2/1986 European Pat. Off. ..... H01K 1/46

0618609 10/1994 European Pat. Off. ..... H01K 1/46

OTHER PUBLICATIONS

Patent Abstracts of Japan, vol. 096, No. 005, May 31, 1996 & JP 08 007848, Jan. 12, 1996.

*Primary Examiner*—Nimeshkumar D. Patel
*Assistant Examiner*—Joseph Williams
*Attorney, Agent, or Firm*—William E. Meyer

[57] ABSTRACT

An electric lamp may be formed with a lamp bulb, with lead wires leading out from the lamp bulb and with a base which incorporates a connection region made of electrically insulating material and provided with electrical connections. The connection region includes a cavity into which at least one lead wire of the electric lamp projects, and at least one electric connection of the base is formed by a contact lug which projects into the cavity in an electrically conducting manner with a lead wire of the lamp. A shaped part consisting of heat-resistant, elastic material is located in the cavity of the connection region. The shaped part has one or more passages for each lead wire of the electric lamp. The shaped part sits on a contact lug and abuts the wall delimiting the cavity in a press fit, and the lead wires pass through the shaped part.

13 Claims, 3 Drawing Sheets

ELECTRIC VEHICLE LAMP WITH INSERTED INSULATION PLUG

TECHNICAL FIELD

The invention relates to electric lamps and particularly to vehicle lamps. More particularly the invention is concerned with a vehicle headlamp capsule.

BACKGROUND ART

A lamp of the type of the preamble of Patent claim 1 has been disclosed, for example, in patent EP 0 172 529. That document describes an electric incandescent lamp, in particular a lamp for a motor vehicle headlight, with a lamp bulb pinched on one side and a lamp base consisting of metal and plastic parts. The pinch base of the lamp bulb is mounted in a metallic holder part of the lamp base, whereas the electric connections of the lamp are configured as contact lugs and are housed in the lower part of the base which is made of plastic. The lower part of the base manifests a cavity into which extend the lead wires of the lamp coming from the pinch base. These lead wires are each welded to an end of a contact lug inside the cavity of the lower part of the base. A potting compound is poured into the cavity to seal off the base. This seal ensures that no moisture, which would cause corrosion of the reflector, enters the headlight through the lamp base.

It is the object of this invention to make available an electric lamp with a gas-tight base which manifests improved construction and, in particular, requires no cement or potting compound for the seal.

The electric lamp in accordance with the invention incorporates a lamp base with a connection region made of electrically insulating material in which the electrical connections of the lamp are housed. The connection region manifests a cavity into which project one or more lead wires coming from the lamp bulb. There they are each connected in electrically conducting manner to the end of an electrical connection configured as a contact lug. The lamp base is sealed off according to the invention by means of one or more shaped parts provided with passages for the lead wires and made of heat-resistant, elastic and slightly compressible material. The shaped part(s) sits on at least one contact lug and abuts with a press-fit both the wall that delimits the cavity and the lead wire(s) lead through. The press-fit is advantageously produced by the at least one contact lug which exerts a pressure on the shaped part(s). In addition the shaped part(s) is (are) advantageously located in precisely matching recesses. The pressure exerted by the at least one contact lug on the shaped part(s) is thus evenly distributed across the entire body of the shaped part(s), and an optimum press-fit of the shaped part(s) is achieved on the adjacent cavity walls and the lead wire(s) lead through. In the preferred embodiment the shaped part(s) advantageously consist of silicon. The use of several comparatively thick-walled, tube-like, silicon shaped part(s) which each have a passage for one of the lead wires projecting into the cavity of the connection region has proven successful.

The ends of the contact lugs extending into the cavity advantageously have a claw-like shape and either hook or claw the cavity wall. A secure provisional mounting of the contact lugs which are under mechanical tension can thus be assured before the welding of the contact lugs to the lead wires. To facilitate the welding of the lead wires to the associated contact lugs, the contact lugs are advantageously each provided with a passage for the lead wire.

The passages for the contact lug(s) in the connection region of the base are each preferably provided with an insert bevel which permits an inclined introduction of the contact lugs relative to the base axis and then tipping of the contact lugs in the base axis.

The cavity of the connection region is closed with a cover which advantageously incorporates a web extending into the cavity which sits on the surface of the contact lug(s) facing away from the shaped part or parts. This web provides additional support for the contact lugs. The connection region of the base preferably consists of heat-resistant plastic.

DISCLOSURE OF THE INVENTION

An electric lamp may be made with a lamp bulb having lead wires leading out from the lamp bulb. The bulb is supported by a base which incorporates a connection region made of electrically insulating material and provided with electrical connections, wherein the connection region has a cavity into which a lead wire projects, and an electric connection of the base is formed by a contact lug which projects into the cavity in an electrically conducting manner with a lead wire of the lamp. The lamp further has a shaped part consisting of a heat-resistant, elastic material that is located in the cavity of the connection region. The shaped part has a passage for a lead wire of the electric lamp, and sits on at least one contact lug and abuts in a press fit the wall delimiting the cavity.

BEST MODE FOR CARRYING OUT THE INVENTION

Figure 1:
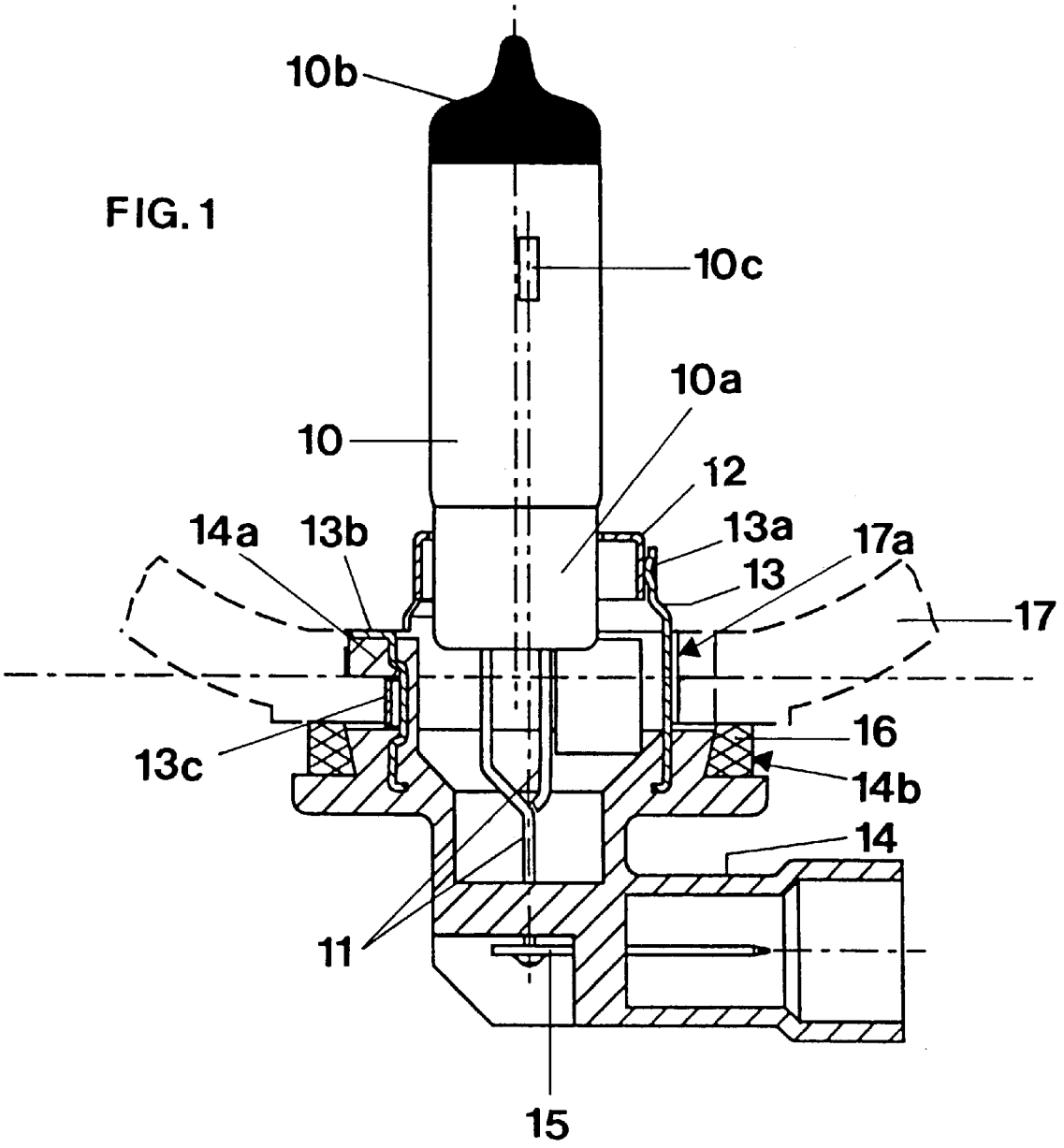
FIG. 1 shows a schematic, cross-sectional illustration of the electric lamp according to the preferred embodiment.

The preferred embodiment of the electric lamp according to the invention involves a single-filament, halogen incandescent lamp for use in a motor vehicle headlight. This lamp incorporates an essentially cylindrical glass lamp bulb 10 with a pinch-sealed lamp bulb end 10*a* which is usually called a pinch end 10*a*. The dome 10*b* of the lamp bulb 10 manifests a black, light-absorbing coating. An incandescent filament (10*c*), aligned parallel to the lamp bulb axis and electrically connected to the lead wires 11 extending from the pinch end 10*a*, serves as the light source. The lamp bulb 10 is fixed in position with its pinch end 10*a* by a metallic holder 12 configured as a fastening ring. The fastening ring 12 is supported by a ring-shaped, metallic support sleeve 13. The support sleeve 13 manifests four shaped, weld tabs 13*a* which are spot or laser welded to the fastening ring 12. In addition to the metallic fastening ring 12 and the metallic support sleeve 13, the lamp base incorporates a plastic base part 14 provided with the electrical connections 15 of the lamp in which the support sleeve 13 is anchored. This plastic base part 14 forms the connection region of the lamp base. The electrical connections 15 of the lamp are configured as contact lugs, each of which is welded to one of the lead wires 11. The plastic base part 14 is an injection-molded part into which the metallic support sleeve 13 is injected. The plastic base part 14 has three integrally formed reference lugs 14*a* placed equidistantly along a periphery which serve to align the incandescent filament 10*c* and to secure the lamp in the reflector 17 of the headlight. The reference lugs 14*a* engaging in opening 17*a* in the reflector 17 which is designed as the lamp holder are each covered by a covering clip 13*b* integrally formed on the support sleeve 13 and angled-off therfrom and are thus protected from the infra-red radiation generated by the incandescent filament 10*c*. The plastic base part 14 in addition manifests a ring-shaped, circumferential, cylindrical groove 14*b* in which a gasket 16 of rubber or silicon is located. The gasket 16 rests on the outside of the reflector wall 17 and seals off the reflector opening 17*a* that is designed as the lamp holder. The inner diameter of the gasket 16 is accurately matched to the tapered groove 14*b* and varies linearly with the height of the gasket. The three reference lugs 14*a*, the gasket 16 and a pressing spring 13*c* that is integrally formed on the metallic support sleeve 13 below one of the reference lugs 14*a* serve to secure the lamp in the lamp holder 17*a* of the reflector. The lamp base and the lamp holder 17*a* form a bayonet connection.

Figure 2:
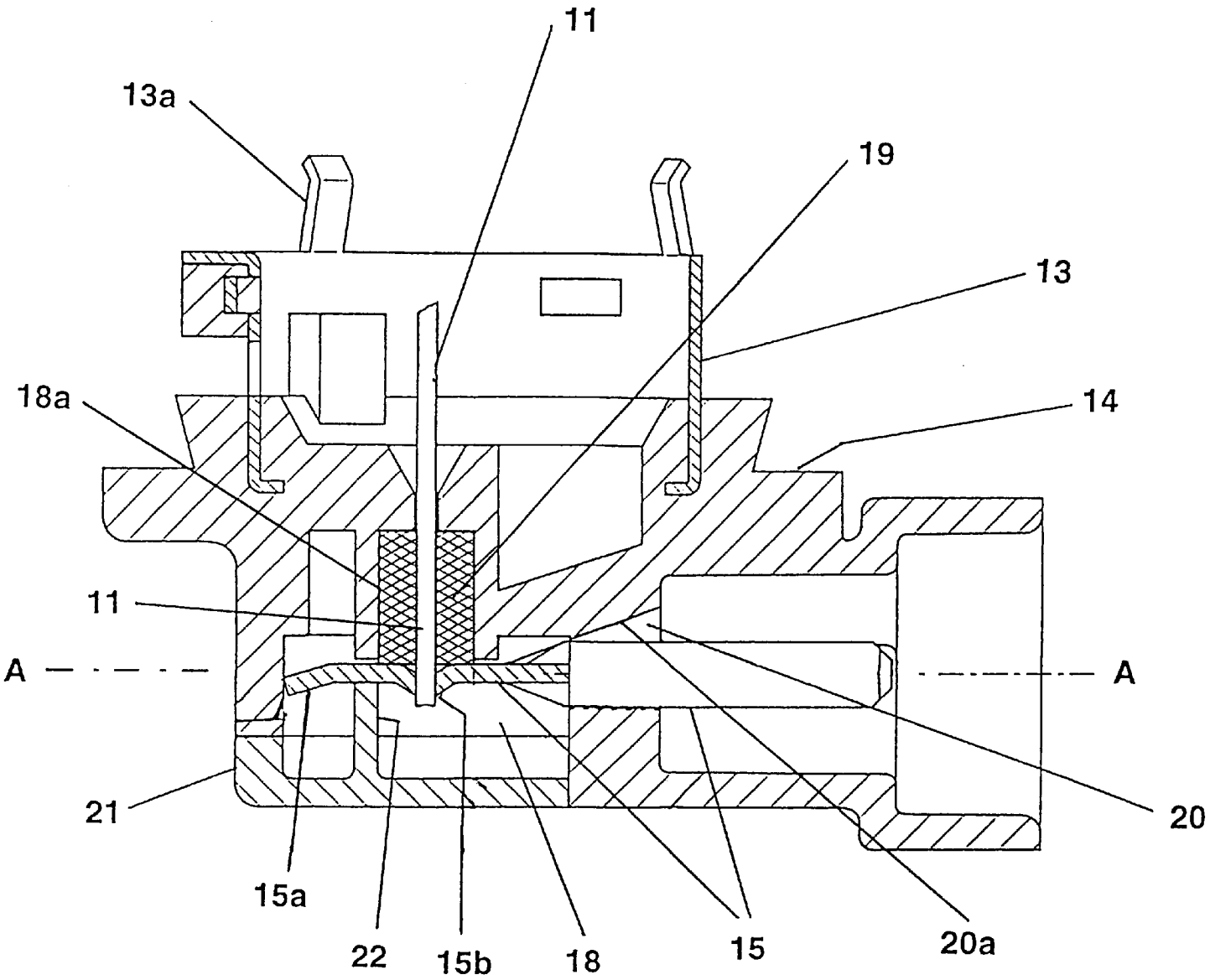
FIG. 2 shows a cross-section of the connection region of the base of the lamp according to the preferred embodiment of FIG. 1.

Details of the plastic base part 14 which forms the connection region are shown in FIG. 2. For the sake of clarity, the pinch end 10*a* is not depicted in FIG. 2 and the lead wires 11 are shown only in part, that is, not in full length.

The plastic base part 14 includes a cavity 18 into which project the two lead wires 11 coming from the pinch end 10*a* of the lamp bulb 10 as well as the ends of the two contact lugs 15. Two tube-like, shaped parts 19 of silicon are located in the cavity 18 and are placed in an exactly matching recess 18*a* formed by the walls of plastic base part 14. The outer diameter of the tube-like, shaped parts 19 is significantly greater than the inner diameter thereof. Each of the lead wires 11 is led through the passage in a tube-like, shaped part 19 and through an opening 15*b* in the end of the contact lug 15 welded to it which projects into the cavity 18. The shaped parts 19 each sit on a contact lug 15. Each contact lug 15 exerts a pressure on the corresponding shaped part 19, so that the shaped part is slightly compressed in the tube axis and thereby abuts by a press fit the walls defining the recess 18*a* and the lead wire 11 led through. In this manner a gas-tight seal of the lamp base is made in the region of the lead wires 11.

The ends 15*a* of the contact lugs 15 projecting into the cavity 18 are shaped like claws and hooked into the rear wall of the plastic base part 14. The passages 20 in the plastic base part 14 for the contact lugs 15 each manifest an insert bevel 20*a* which facilitates the mounting of the contact lugs 15. The cavity 18 is closed by means of a snap-on cover 21. The inside of the cover 21 is equipped with an integrally formed web 22 that extends into the cavity 18 and sits on the surface of the contact lug(s) 15 facing away from the shaped parts 19 and provides additional support for the contact lugs 15 which are under mechanical tension.

When assembling the base of the lamp, after securing the fastening ring 12 bearing the pinch end 10*a* to the support member 13, the tube-like shaped parts 19 are threaded on the corresponding lead wires 11 and inserted in the respective, exactly matching recess 18*a*. Then the contact lugs 15 are passed through the passage 20 in the plastic base part 14, coming from the cavity 18 along the insert bevel 20*a* extending at an angle to base axis A—A. Finally the contact lugs 15 are tipped in the base axis A—A, so that the lead wires 11 extend through the opening 15*b* in the corresponding contact lug 15. The tube-like shaped parts 19 are pressed by the contact lugs 15 into the recesses 18*a* and slightly compressed, so that shaped parts 19 abut by a press fit on the walls delimiting the recesses 18*a* and on the lead wires 11 passed through the shaped parts 19. When the contact lugs 15 are tipped in the base axis A—A, the claw-like ends 15*a* of the contact lugs 15 simultaneously hook into the rear wall of the plastic base part 14. The axial alignment of the contact lugs 15 is thus provisionally fixed. Finally the ends of the lead wires 11 extending through the openings 15*b* are welded to the contact lugs 15. The cavity 18 is then closed by means of the snap-on cover 21.

Figure 3:
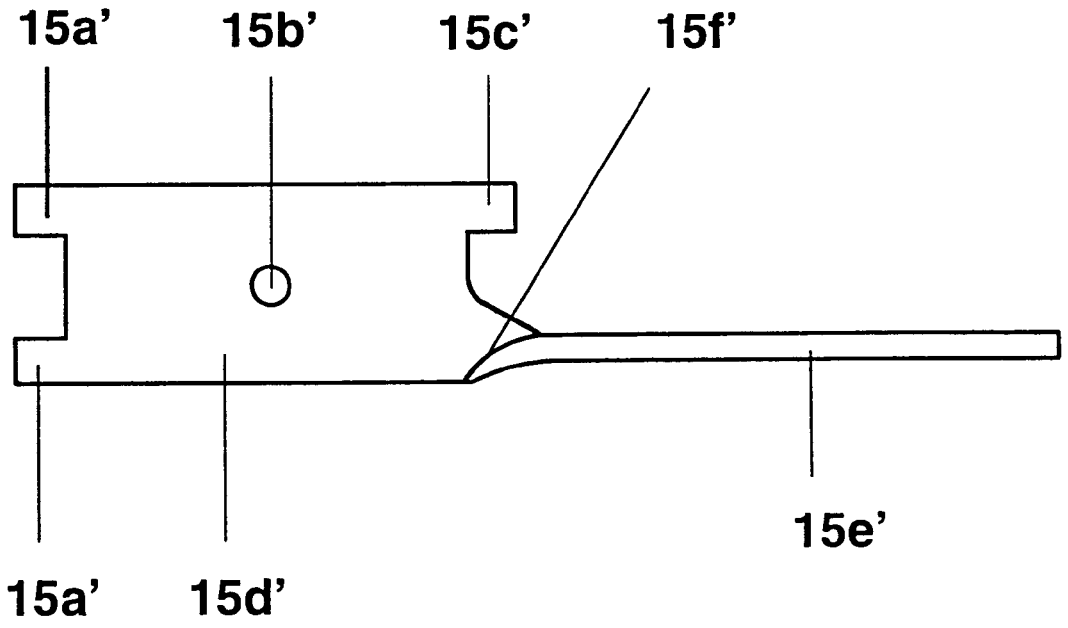
FIG. 3 shows a top plan view of the contact lug according to a second embodiment.
Figure 4:
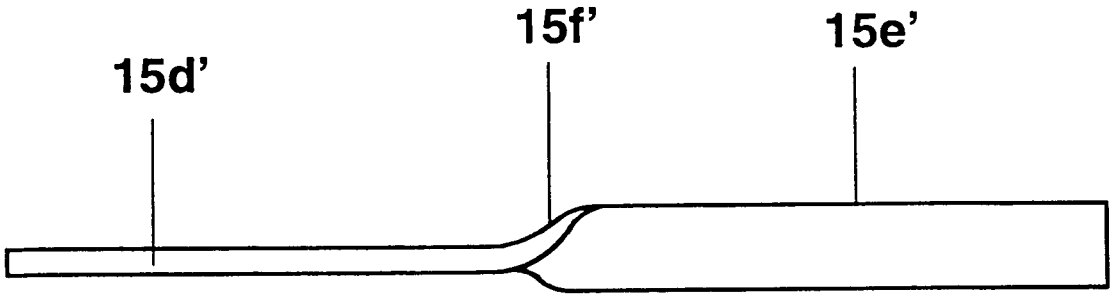
FIG. 4 shows a side view of the contact lug according to the second embodiment of FIG. 3.

FIGS. 3 and 4 show a second embodiment of a contact lug. The contact lug 15' according to the second embodiment manifests a rectangular support surface 15*d'* with an opening 15*b'* for a lead wire 11 on which the contact surface 15*e'* is integrally formed. The support surface 15*d'* and the contact surface 15*e'* are positioned vertical to each other and connected to each other by a twisted region 15*f'*. A total of three claws 15*a'*, 15*c'* are integrally formed on the support surface 15*d'* of the contact lug 15' pressing against the shaped part 19 which hook into the base wall during the mounting of the contact lug 15'. Two 15*a'* of these claws 15*a'*, 15*c'* are formed on the side of the support surface 15*d'* opposite the contact lug 15*e'*, while the third claw 15*c'* is formed on the same side of the support surface 15*d'* as the contact surface 15*e'*. In contrast to the contact lug 15 of the first embodiment the claws 15*a'*, 15*c'* are not bent from the support surface 15*d'* but instead are in the same plane.

The invention is not limited to the embodiments described above. Instead of several tube-like shaped parts, a single shaped part, for example, consisting of heat-resistant, elastic and slightly compressible material and with several passages for the lead wires coming from the lamp bulb can be used. In addition the shaped parts do not have to be made of silicon, but instead can consist of other material with similar heat-resistance, elasticity and compressibility as silicon. Furthermore the ends of the contact lugs extending into the cavity of the plastic base part can, for example, engage behind a protrusion in the cavity wall. They do not have to be designed in a claw-like fashion. Duro-plastic and thermal plastic customarily used in lamp technology are suitable material for the plastic base part 14.

What is claimed is:

1. An electric lamp with a lamp bulb having lead wires leading out from the lamp bulb (10), the bulb being supported by a base which incorporates a connection region (14) made of electrically insulating material and provided with electrical connections (15), wherein the connection region (14) manifests a cavity (18) into which at least one lead wire (11) of the electric lamp projects, and at least one electric connection (15) of the base is formed by a contact lug which projects into the cavity in an electrically conducting manner with a lead wire (11) of the lamp, further characterized in that at least one part (19) consisting of a heat-resistant, elastic material is located in the cavity (18) of the connection region (14), the shaped part (19) has at least one passage for a lead wire (11) of the electric lamp, the shaped part (19) sits on at least one contact lug (15) and abuts in a press fit the wall delimiting the cavity (18) and the at least one lead wire (11) passed therethrough.

2. The electric lamp according to claim 1, characterized in that the shaped part comprises of a heat resistant, elastic and slightly compressible material.

3. The electric lamp according to claim 1, characterized in that the shaped part (19) is positioned in an exactly matching recess (18*a*).

4. The electric lamp according to claim 1, characterized in that the shaped part (19) consists of silicon.

5. The electric lamp according to claim 3, characterized in that a tube-like shaped part (19) is available for each lead wire (11) projecting into the cavity.

6. The electric lamp according to claim 1, characterized in that a press-fit is produced in that the at least one contact lug (15) exerts pressure on the shaped part (19).

7. The electric lamp according to claim 1, characterized in that the end (15*a*) of the at least one contact lug (15) that projects into the cavity (18) is hooked on a wall of the base.

8. The electric lamp according to claim 7, characterized in that the end (15*a*) of the at least one contact lug (15) that projects into the cavity (18) is shaped like a claw.

9. The electric lamp according to claim 1, characterized in that the at least one contact lug (15) has an opening (15*b*) for the lead wire (11) connected to the at least one contact lug (15).

10. The electric lamp according to claim 1, characterized in that the connection region (14) of the base consists of plastic.

11. The electric lamp according to claim 1, characterized in that the connection region (14) has a passage (20) for the at least one contact lug (15), the said passage having an insert bevel (20*a*) which permits the introduction of the contact lugs (15) at an angle to the base axis A—A and then the tipping of the contact lugs (15) in the base axis (A—A).

12. The electric lamp according to claim 1, characterized in that the base has a cover (21) which closes off the cavity (18) in the connection region (14).

13. The electric lamp according to claim 12, characterized in that the cover (21) has a web extending into the cavity (18) and said web sits on a surface of the at least one contact lug (15) that faces away from the shaped part (19).

* * * * *